US005577966A

United States Patent [19]

Duran

[11] Patent Number: 5,577,966

[45] **Date of Patent: *Nov. 26, 1996**

[54] SPORT SWING TRAINING AID

[76] Inventor: Anthony P. Duran, 135 Main St., Depew, N.Y. 14043

[ * ] Notice: The term of this patent shall not extend beyond the expiration date of Pat. No. 5,405,138.

[21] Appl. No.: 358,804

[22] Filed: Dec. 19, 1994

Related U.S. Application Data

[63] Continuation-in-part of Ser. No. 95,070, Jul. 20, 1993, Pat. No. 5,405,138.

[51] Int. Cl.[6] ..... A63B 69/36

[52] U.S. Cl. ..... 473/234; 273/26 B; 273/67 R; 473/235

[58] Field of Search ..... 273/26 B, 72 R, 273/186.2, 67 R, 72 A, 183.1, 29 R, 73 R; 446/204; 473/234, 235

[56] References Cited

U.S. PATENT DOCUMENTS

| | | | |
|---|---|---|---|
| 1,113,162 | 10/1914 | Murphy | 446/204 |
| 2,950,115 | 8/1960 | Hurdzan | 273/170 |
| 3,136,546 | 6/1964 | Connolly | 273/26 B |
| 3,236,521 | 2/1966 | Knott | 273/26 B |
| 3,428,325 | 2/1969 | Atkinson | 273/26 B |
| 4,283,057 | 8/1981 | Ragan | 273/186.2 |
| 4,634,121 | 1/1987 | Sasaki | 273/26 B |
| 5,014,984 | 5/1991 | Brockhoff | 273/67 |
| 5,133,551 | 7/1992 | Handy et al. | 273/72 R |
| 5,360,209 | 11/1994 | Mollica | 273/72 R |
| 5,405,138 | 4/1995 | Duran | 273/26 B |

OTHER PUBLICATIONS

Photographs and description of prior device in file of Ser. #08/095,070.

*Primary Examiner*—Mark S. Graham
*Attorney, Agent, or Firm*—Joseph P. Gastel

[57] ABSTRACT

A sport swing training aid for practicing the swing of a ball-hitting device including an elongated rod-like member having first and second ends, a grip on said first end, a stop on said second end, the rod-like member being hollow and internally corrugated and being capable of producing a tone as air passes through the member during the swinging thereof to produce a tone which varies in length and pitch in direct proportion with the velocity and duration of the movement of the ball-striking end as it is swung through a ball-striking zone, to thereby provide an audible feedback to the player as to the tempo and rhythm of the swing, and a slidable sleeve on the elongated rod-like member for travel between the first and second ends as the elongated rod-like member is swung, the stop and sleeve being of sufficient hardness to produce the feel and sound of the striking of a ball upon impact between the sleeve and stop.

8 Claims, 4 Drawing Sheets

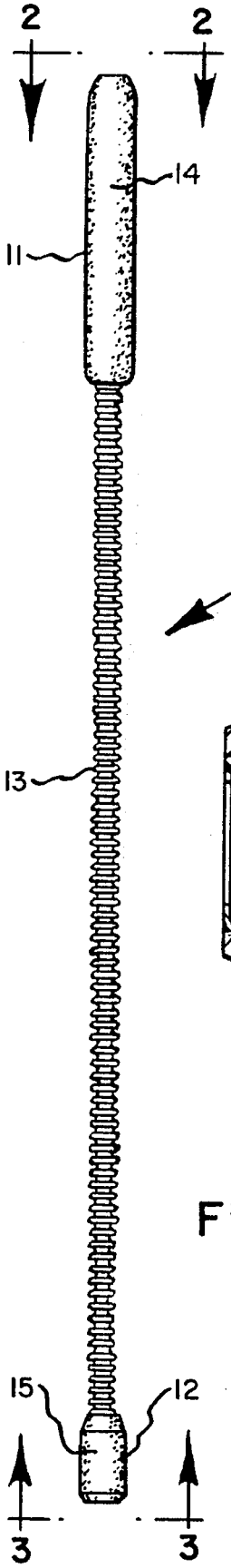
Fig. 1.
Fig. 2.
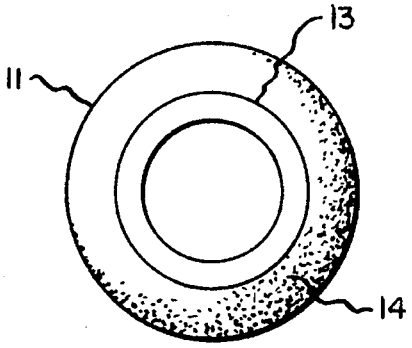
Fig. 3.
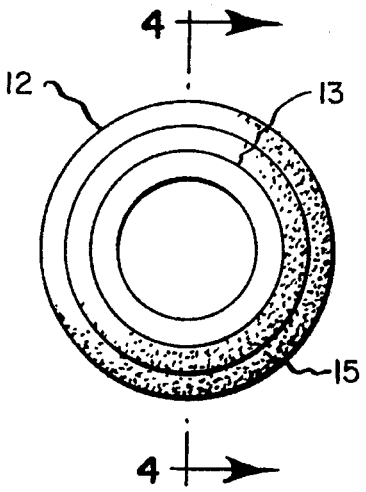
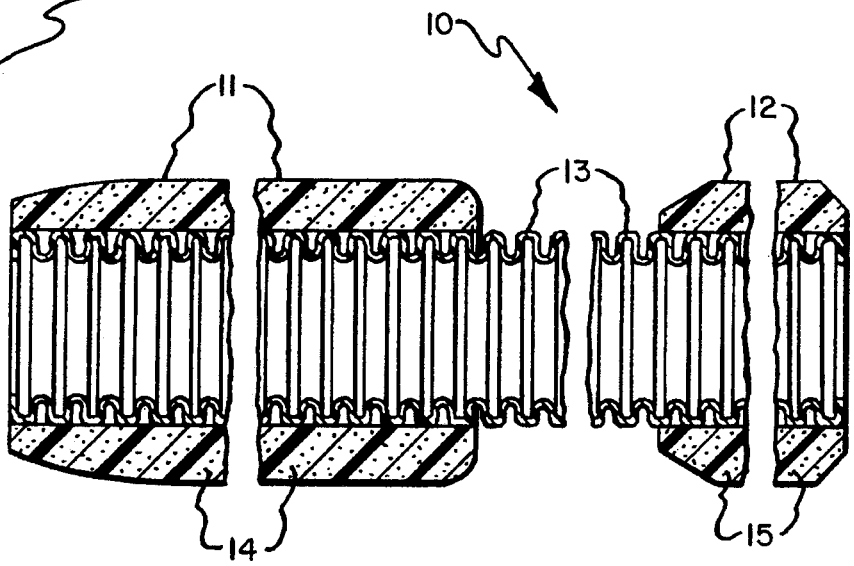
Fig. 4.
Fig. 5.
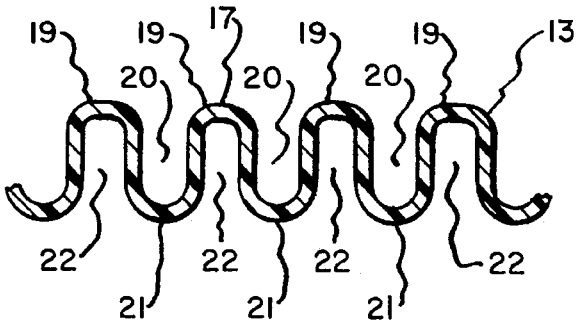

Fig. 6.
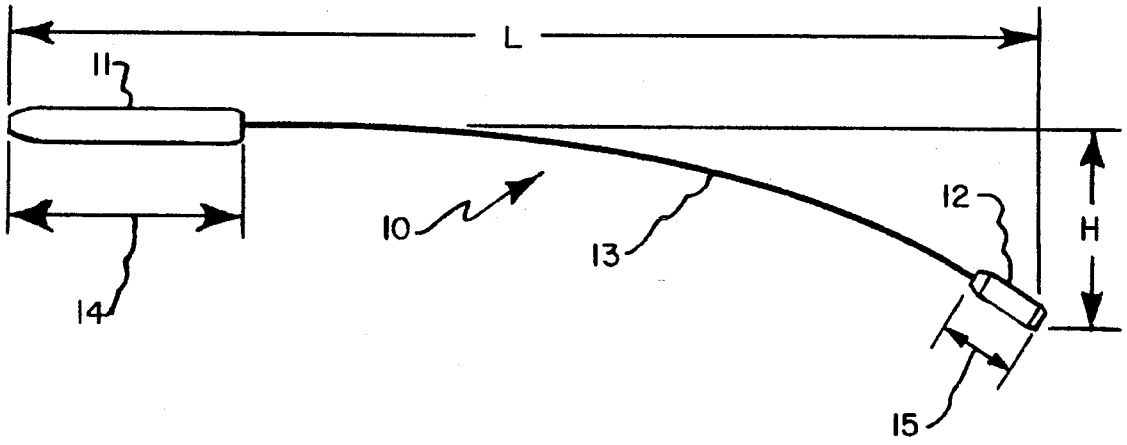
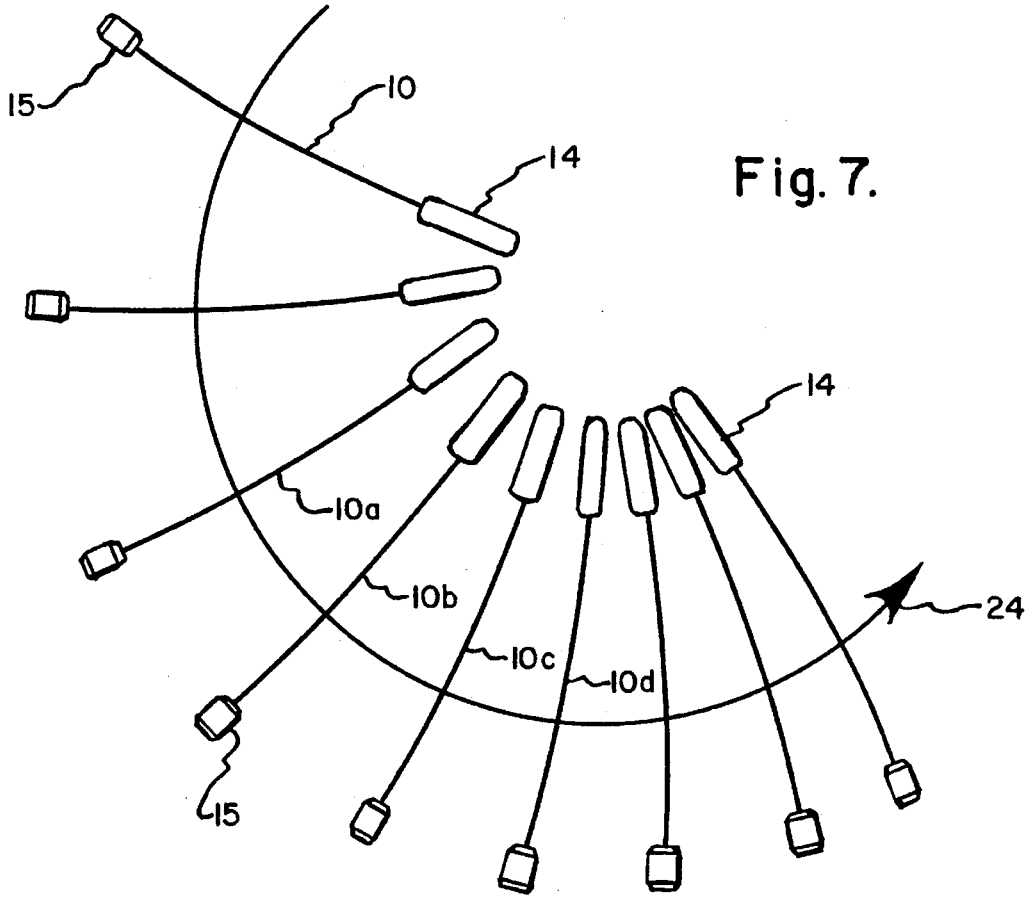
Fig. 7.

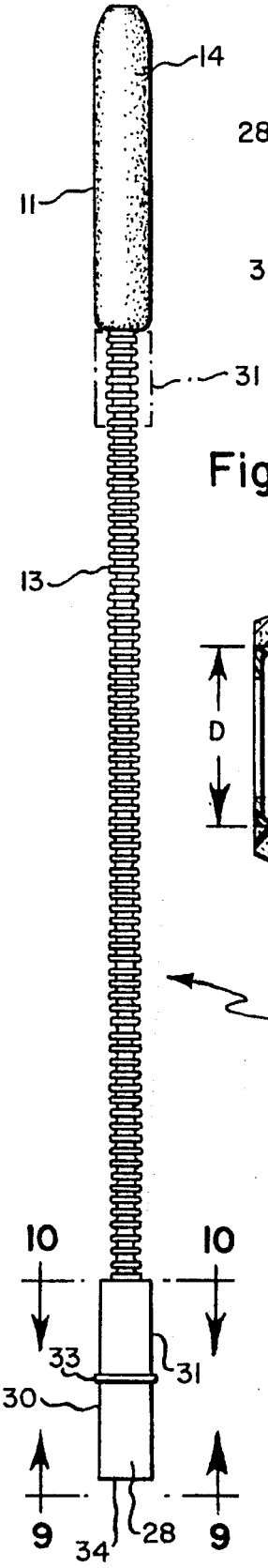
Fig. 8.
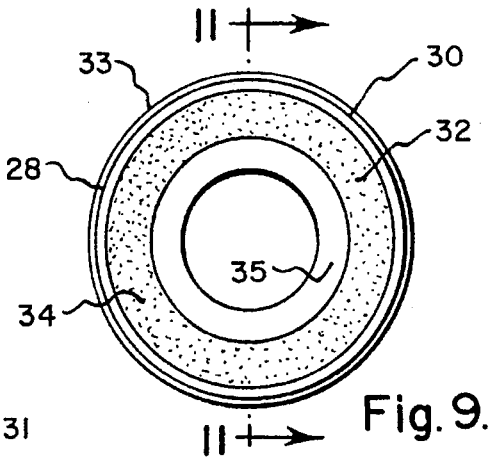
Fig. 9.
Fig. 10.
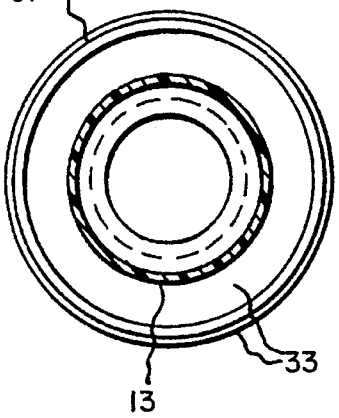
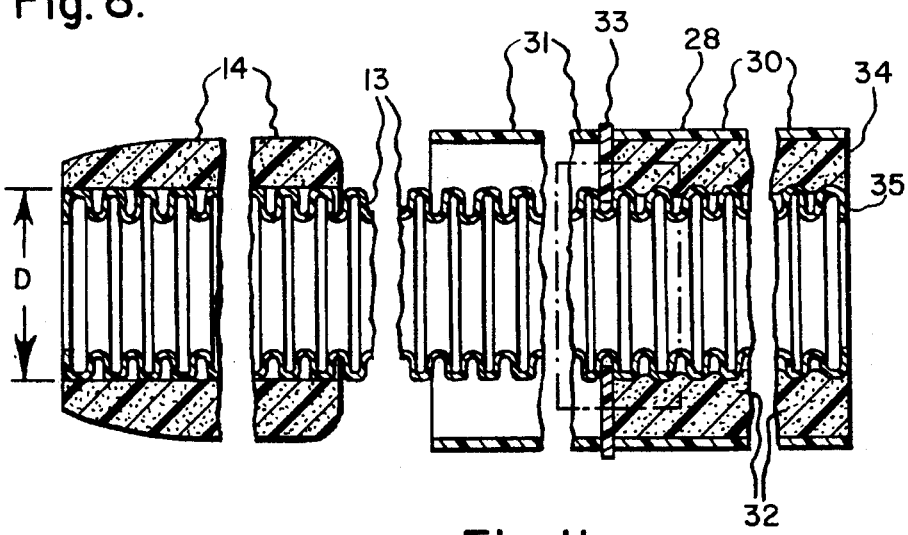
Fig. 11.
Fig. 12.
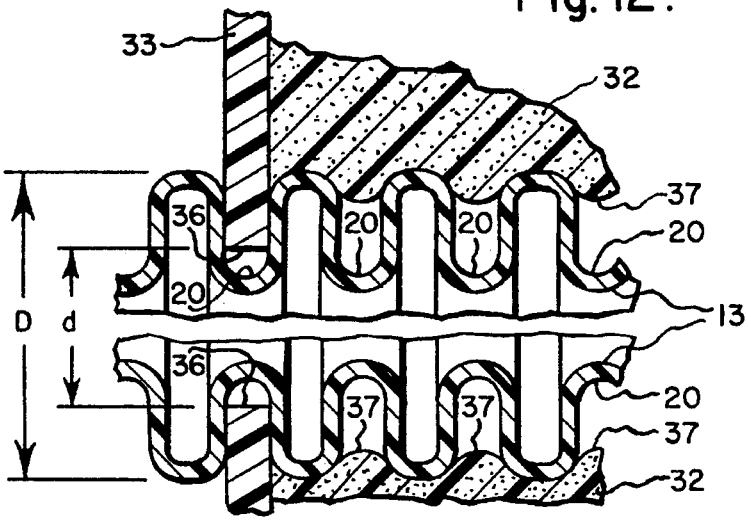

SPORT SWING TRAINING AID

CROSS REFERENCE TO RELATED APPLICATIONS

The present application is a continuation-in-part of application Ser. No. 08/095,070, filed Jul. 20, 1993 U.S. Pat. No. 5,405,138.

BACKGROUND OF THE INVENTION

The present invention relates to a sport swing training aid for practicing the swing of a ball-hitting device.

By way of background, in all sports wherein a rod-like member, such as a golf club, baseball bat or tennis racket, is used to strike a ball, the quality of the swing depends on the proper tempo and rhythm provided by the player.

SUMMARY OF THE INVENTION

It is the object of the present invention to provide a sport swing training aid for practicing the swing of a ball-hitting device which teaches the proper tempo and rhythm of a smooth powerful swing by providing a special audible feedback to the player when the swing is at an optimum value.

Another object of the present invention is to provide a sport swing training aid for practicing the swing of a ball-hitting device wherein the swing can be practiced anywhere that there is enough space, such as in an office or outdoors without requiring the use of the actual ball-hitting device.

A further object of the present invention is to provide a sport swing training aid for practicing the swing of a ball-hitting device which can be used for warming up and limbering the muscles prior to actually engaging in the sport.

Yet another object of the present invention is to provide a sport swing training aid which will produce the sound and feel of striking a ball in addition to providing the audible feedback when the tempo and rhythm is at an optimum value.

A still further object of the present invention is to provide a sport swing training aid which will permit visual tracking of the path of the ball-hitting device, namely, a golf club in addition to providing the audible feedback when the tempo and rhythm is at an optimum value. Other objects and attendant advantages of the present invention will readily be perceived hereafter.

The present invention relates to a sport swing training aid for practicing the swing of a ball-hitting device comprising an elongated rod-like member having first and second ends, a grip on said first end, a stop on said second end, and a slidable sleeve on said elongated rod-like member for travel between said first and second ends when said elongated rod-like member is swung, said sleeve and said stop being of sufficient hardness to produce the feel and sound of the striking of a ball upon impact between said sleeve and said stop.

The present invention also relates to a sport swing training aid for practicing the swing of a ball-hitting device comprising an elongated rod-like member having first and second ends, a grip on said first end, a stop on said second end, said elongated rod-like member being of a first color, and a second member on said elongated rod-like member for selective positioning on said elongated rod-like member adjacent said second end and being of a different color than said elongated rod-like member for providing a visual indication of the path of said second end as said elongated rod-like member is swung.

The various aspects of the present invention will be more fully understood when the following portions of the specification are read in conjunction with the accompanying drawings wherein:

BRIEF DESCRIPTION OF THE DRAWINGS

FIG. 1 is a side elevational view of the sport swing training aid of the present invention;

FIG. 2 is an end elevational view taken substantially in the direction of arrows 2—2 of FIG. 1;

FIG. 3 is an end elevational view taken substantially in the direction of arrows 3—3 of FIG. 1;

FIG. 4 is a fragmentary cross sectional view taken substantially along line 4—4 of FIG. 2;

FIG. 5 is a fragmentary enlarged cross sectional view of the configuration of the wall of the tubular rod-like member;

FIG. 6 is a schematic view showing the inherent flexibility of the rod-like member;

FIG. 7 is a schematic view showing the acceleration of the rod-like member through a ball hitting zone which provides the higher pitch and length of duration of the tone produced by the member;

FIG. 8 is a side elevational view of the sport swing training aid containing a slidable sleeve with the sleeve shown in solid lines against the end stop and in dotted lines adjacent the handle;

FIG. 9 is an end elevational view taken substantially in the direction of arrows 9—9 of FIG. 8;

FIG. 10 is a cross sectional view taken substantially along line 10—10 of FIG. 8;

FIG. 11 is a fragmentary enlarged cross sectional view taken substantially along line 11—11 of FIG. 9;

FIG. 12 is an enlarged fragmentary cross sectional view of a portion of FIG. 11 within dot-dash lines;

DESCRIPTION OF THE PREFERRED EMBODIMENTS

Figure 13:
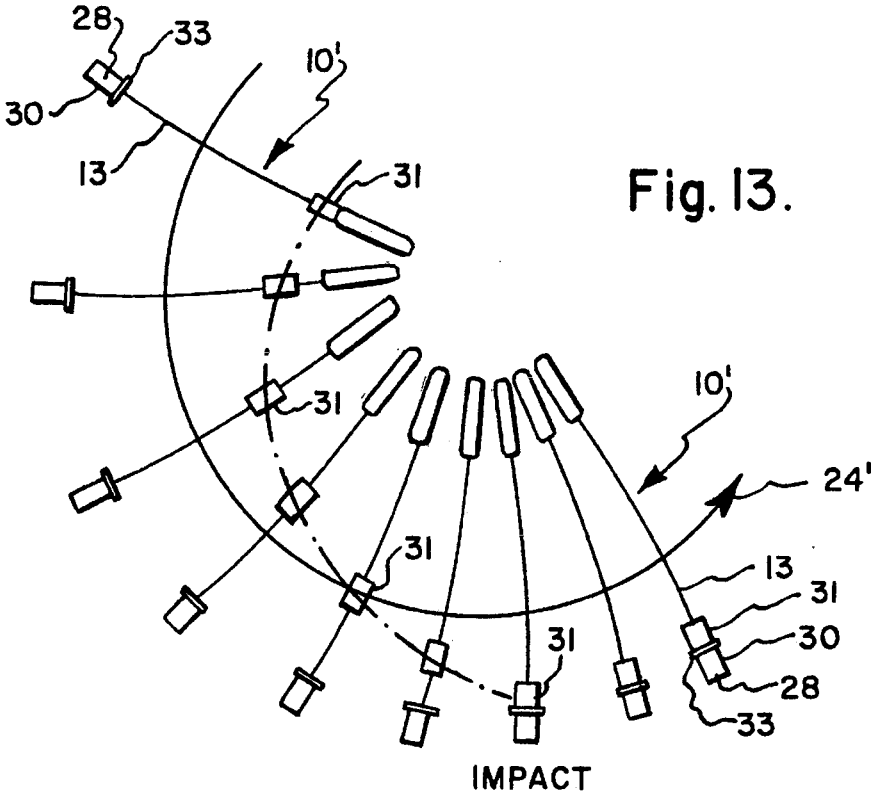
FIG. 13 is a schematic view similar to FIG. 7 showing the acceleration of the rod-like member through a ball-hitting zone and also showing the movement of the slidable sleeve during the swing from its position proximate the grip and terminating at the ball-hitting area.

The sport swing training aid for practicing the swing of a ball-hitting device, in this instance a golf club, comprises a rod-like member 10 having a grip end 11, and a remote end 12 representative of a ball-striking surface. The rod-like member 10 includes an elongated hollow ribbed tubular plastic member 13 which is slightly flexible. An annular foam plastic grip 14 is mounted on one end of member 13, and a shorter like annular foam member 15 is mounted on the other end and represents a ball-striking surface.

The tubular plastic member 13 has an annular wall 17 which is corrugated in that it has external ridges 19 alternating with external grooves 20, and it has internal ridges 21 alternating with internal grooves 22. The ridges 19 and 21 extend perpendicularly to the longitudinal axis of member 13 and they are spaced from each other by the grooves. The ridges 19 are not helical; they are separate spaced ridges.

The same is true of internal ridges 21 which lie directly opposite to grooves 20. The tubular member 13 is commercially available and is known as CARLON FLEX PLUS ribbed electrical nonmetallic tubing.

In FIG. 6 the physical characteristics of the sport swing training aid 10 are shown. The overall length L is 40 inches. The length of grip 14 is 8½ inches. The length of foam member 15 is 2⅜ inches. The outer diameter of member 13 is ⅞ inches; the inner diameter of member 13 is ½ inch, and the ribs are approximately 1/16 of an inch wide. When the grip 14 is held horizontally and the rod 13 is permitted to flex of its own weight, there will be a drop of the ball-striking portion 15 in an amount H of approximately 7½ inches. it will be appreciated that the stiffness of member 13 can be varied to simulate shafts of different stiffness.

As noted above, the purpose of the sport swing training aid 10 is to develop good tempo and rhythm to provide a smooth powerful swing of a golf club, in this instance. The reason that the sport swing training aid provides the foregoing result is because the proper swing can be detected audibly. In this respect, as the training aid 10 is swung in the path of a golf swing, it generates a higher tone as the ball-striking surface 15 passes through the ball-striking zone. The higher the pitch of this tone and the longer its duration through the ball-hitting zone, the better is the golf swing. This can be explained more readily by the schematic representation of FIG. 7 wherein the various positions of the rod-like member 10 are shown as it is swung in the direction of arrow 24 toward a ball. It can readily be seen that at positions between 10*a*, 10*b*, 10*c* and 10*d* there is an acceleration of the ball-striking surface 15 due to the wrist action of the golfer. The longer that the tone occurs and the higher the pitch as the rod 13 passes through the ball-striking zone, the better is the rhythm and tempo resulting from the entire swing. This tone is an audible feedback to the golfer. Thus, the golfer can audibly detect a good tempo and rhythm to provide the proper timing for a smooth powerful swing.

The above principles applied to a golf swing are equally applicable to other ball or projectile hitting devices including a baseball bat and a tennis racket. In fact, it is believed that the sport training aid can be used in any sport wherein a ball or projectile is struck by a rod-like member or a member which acts like a rod-like member. It will also be appreciated that the length of the member 10 can be varied to represent the rod-like members used in different sports and, further, the stiffness of the member can be varied. For baseball and tennis a member like member 10 is used, with the only difference being that the member is 30 inches long.

It is believed that the tone is generated as air is forced through the hollow member 13, and more specifically it is believed that it is caused by the internal ribbing. It is also contemplated that the tone can also be generated by placing a suitably shaped orifice in a hollow member so that as air rushes therethrough, a tone will be generated.

In FIGS. 8–14 another embodiment of the present invention is disclosed. The sports swing training aid, in this instance, a golf club, comprises a rod-like member 10' which has some identical parts of rod-like member 10 of FIGS. 1–7. Identical numerals of the two embodiments represent identical parts. Therefore, another description of such identical parts will not be repeated. The embodiment of FIGS. 8–14 differs from that of FIGS. 1–7 in that a stop structure 30 is located at the end of tubular plastic member 13 remote from grip 14. A sleeve 31 is slidable between its dotted-line position proximate grip 14 and the solid-line position at stop 30 when rod-like member 10 is swung during a simulated golf swing. Stop 30 consists of a hollow rigid tubular plastic sleeve 28 mounted snugly on the outside of an annular flexible resilient foam plastic core 32. A hard slightly flexible plastic disc 33 is bonded to the end of plastic tubular member 30, and it has a central hole 36 having an internal diameter d (FIG. 12) which is less than the external diameter D of tubular plastic member 13 but is slightly larger than the diameter of member 13 at the grooves 20. The stop 30 can be forced over the end of member 13 because annular disc 33 is slightly flexible, and it can be brought to rest within a groove, such as 20 in FIG. 12, so that the outer end 34 of stop 30 is flush with the end 35 of rod member 13. The foam plastic core 32 has a bore which originally had a diameter d, and since it is flexible and resilient, it configures itself into the outer portions of grooves 20 at 37 to thereby not only aid in retaining stop 30 in position on rod member 13, but it also centers tubular plastic member 28 on rod member 13.

Figure 14:
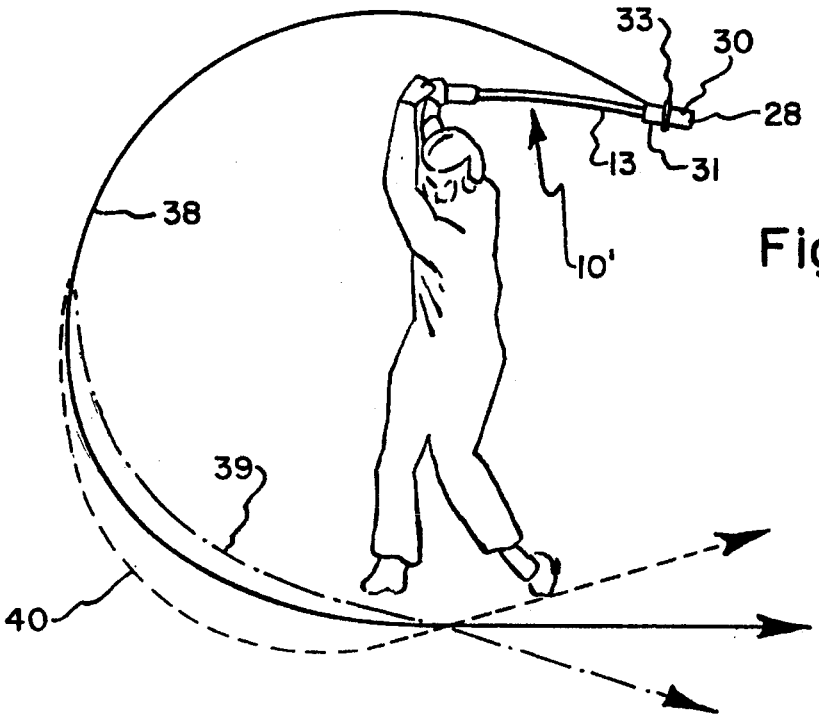
FIG. 14 is a view showing how the sleeve performs a tracking operation for viewing the swing path to determine whether the swing is outside-in or inside-out.

The mode of operation of the embodiment of FIGS. 8–14 is depicted in FIGS. 13 and 14. FIG. 13 is similar to FIG. 7 except that it shows the arc of travel of sleeve 31 during the golf swing. In this respect, the sleeve 31 is initially held by the golfer's thumb as he grips grip 14 during the back swing. When he starts his forward swing, he releases sleeve 31 and as the swing progresses in the direction of arrow 24' in FIG. 13, sleeve 31 will travel down along rod 13 and at the bottom of the stroke it will hit disc 33 of stop 30. At impact, the feel and sound of striking a golf ball will be sensed. It is believed that this is the case because sleeve 31, disc 33 and sleeve 28 are fabricated of sufficiently hard plastic, and sleeve 28 is mounted on foam core 32.

Another aspect of the mode of operation of the golf swing training aid 10' is disclosed in FIG. 14 wherein, during the back swing, the sleeve 31 is left at its lowermost position abutting stop 30. The plastic member 13 is a dark color, preferably black, and the sleeve 31 is white. Thus, as the golf is swung through arc 38, the golfer can see the path of the end of the club. A proper swing will follow the solid line of path 38. However, if the swing is inside out as depicted by dot-dash line 39, or if the swing is outside in as depicted by dotted line 40, this path can be readily observed so that the golfer can visually follow the tracking of sleeve 31 to correct the swing so that it follows the solid-line path 38.

While the foregoing description has referred primarily to a training aid in the nature of golf club which is about 38 inches long, similar results can be obtained with a shorter training aid of about 36 inches long which simulates a baseball bat and with a shorter training aid of about 34 inches long which simulates a tennis racket.

While preferred embodiments of the present invention have been disclosed, it will be appreciated that it is not limited thereto but may be otherwise embodied within the scope of the following claims.

What is claimed is:

1. A sport swing training aid for practicing the swing of a ball-hitting device comprising an elongated rod-like member having first and second ends, a grip on said first end, a stop on said second end, a slidable sleeve on said elongated rod-like member for travel between said first and second ends when said elongated rod-like member is swung, said sleeve and said stop being of sufficient hardness to produce the feel and sound of the striking of a ball upon impact between said sleeve and said stop, said stop comprising a foam core, a second sleeve surrounding said foam core, and a disc at the end of said second sleeve facing said grip.

2. A sport swing training aid as set forth in claim 1 wherein said elongated rod-like member is ribbed with ridges and grooves, and wherein said disc includes an inner portion which fits into one of said grooves.

3. A sport swing training aid as set forth in claim 1 wherein said elongated rod-like member includes external ridges and grooves, and wherein said disc includes a central opening of a diameter which is less than the diameter of said ridges so as to fit into one of said grooves, and wherein said foam core includes a bore which is originally of less diameter than said ridges to thereby configure into the outer portions of said grooves.

4. A sport swing training aid for practicing the swing of a ball-hitting device comprising an elongated rod-like member having first and second ends, a grip on said first end, a stop on said second end, a slidable sleeve on said elongated rod-like member for travel between said first and second ends when said elongated rod-like member is swung, said sleeve and said stop being of sufficient hardness to produce the feel and sound of the striking of a ball upon impact between said sleeve and said stop, said elongated rod-like member being ribbed with ridges and grooves, and said stop including a disc having an inner portion located within a groove.

5. A sport swing training aid as set forth in claim 4 including a second sleeve connected to said disc and located on the opposite side of said disc from said grip.

6. A golf swing training aid for practicing a golf club swing comprising an elongated flexible hollow rod-like member having first and second ends, a grip on said first end, a stop on said second end, a slidable sleeve on said elongated flexible hollow rod-like member for travel between said first and second ends when said elongated rod-like member is swung, said sleeve and said stop being of sufficient hardness to produce the feel and sound of the striking of a ball upon impact between said sleeve and said stop, and tone-producing means on said elongated flexible hollow rod-like member for producing a tone which varies in length and pitch in direct proportion to the velocity and duration of movement of said second end as it is swung through a ball-striking zone, said tone-producing means being located in said elongated flexible hollow rod-like member and comprising internal ribbing within said elongated flexible hollow rod-like member.

7. A golf swing training aid as set forth in claim 6 wherein said sleeve is of a different color than said elongated flexible hollow rod-like member.

8. A golf swing training aid as set forth in claim 6 wherein said sleeve is slidable on said elongated rod-like member to a position adjacent said second end prior to said backswing.

* * * * *